US009816777B2

(12) United States Patent
Wilkinson

(10) Patent No.: US 9,816,777 B2
(45) Date of Patent: Nov. 14, 2017

(54) WRIST STRAP FOR THE BARREL OF A FIREARM

(71) Applicant: Muzzle Force Ltd. Liability Co., Monroe, NC (US)

(72) Inventor: Richard Kent Wilkinson, Monroe, NC (US)

(73) Assignee: MUZZLE FORCE LTD. LIABILITY CO., Monroe, NC (US)

( * ) Notice: Subject to any disclaimer, the term of this patent is extended or adjusted under 35 U.S.C. 154(b) by 0 days.

(21) Appl. No.: 14/926,924

(22) Filed: Oct. 29, 2015

(65) Prior Publication Data

US 2016/0123699 A1 May 5, 2016

Related U.S. Application Data

(60) Provisional application No. 62/073,439, filed on Oct. 31, 2014.

(51) Int. Cl.
*F41C 33/00* (2006.01)
*F41C 27/22* (2006.01)

(52) U.S. Cl.
CPC ..... *F41C 33/002* (2013.01); *F41C 27/22* (2013.01)

(58) Field of Classification Search
CPC ..... F41C 27/22; F41C 33/001–33/002; F41C 23/02; F41C 33/00; Y10T 24/12
USPC ..... 224/150; 24/13, 2.5, 314, 317–318, 351, 24/190, 464, 485, 568, 578.13, 572.1, 24/595.1, 612, 652, 697.1, 265 R, 706, 24/455, 163 R, 305, 31 R, 33 A, 33 P, 24/437
See application file for complete search history.

(56) References Cited

U.S. PATENT DOCUMENTS

| | | | | | |
|---|---|---|---|---|---|
| 3,098,591 | A * | 7/1963 | Lerude | F41C 33/002 | 224/150 |
| 3,927,808 | A * | 12/1975 | Steen | F41C 23/02 | 224/267 |
| 5,400,935 | A * | 3/1995 | Farmer | F41C 33/046 | 224/198 |
| 5,715,979 | A * | 2/1998 | Crandall | F41C 23/02 | 224/150 |
| 6,112,448 | A * | 9/2000 | Gray | F41C 33/001 | 42/85 |
| 2006/0137233 | A1* | 6/2006 | Meeks | F41C 33/001 | 42/94 |
| 2012/0255976 | A1* | 10/2012 | Dees | F41C 33/002 | 224/150 |

* cited by examiner

*Primary Examiner* — Scott McNurlen
(74) *Attorney, Agent, or Firm* — Matthew L. Grell; Jeffrey Watson; Grell & Watson Patent Attorneys LLC

(57) ABSTRACT

A wrist strap for the barrel of a firearm includes a strap having a first end and a second end. The strap has a loop at the first end. The second end of the strap is configured to be attached to the barrel of the firearm. Wherein, the loop is configured for a user to insert their hand and utilize their wrist for stabilizing and/or controlling the barrel of the firearm. Whereby, the strap provides increased stability and/or control of the barrel of the firearm.

11 Claims, 7 Drawing Sheets

WRIST STRAP FOR THE BARREL OF A FIREARM

CROSS-REFERENCE TO RELATED APPLICATIONS

To the full extent permitted by law, the present United States Non-provisional patent application hereby claims priority to and the full benefit of United States Provisional Application entitled "Wrist Strap for the Barrel of a Firearm," having assigned Ser. No. 62/073,439, filed on Oct. 31, 2014, incorporated herein by reference in its entirety.

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE DISCLOSURE

Technical Field of the Disclosure

The present disclosure relates generally to firearms, like long guns. More specifically, the instant disclosure relates to a strap for a firearm that is designed to increase the stability and/or control of the barrel of the firearm or long gun. Even more specifically, the instant disclosure relates to a wrist strap for the barrel of a firearm, like a long gun, that increases the stability and/or control of the barrel.

Description of the Related Art

A long gun is a category of firearms with longer barrels than other classes. In small arms, a long gun is designed to be fired when braced against the shoulder, in contrast to a handgun. The actual lengths of the barrels of a long gun are subject to various laws in many jurisdictions, for example by the National Firearms Act in the United States, which sets a minimum length of 16 inches (40 cm) for rifle barrels and 18 inches (45 cm) for shotgun barrels. Examples of various classes of small arms generally considered long guns include, but are not limited to: rifles, shotguns, muskets, blunderbusses, carbines, wall guns, and musketoons.

Almost all long guns have front grips (forestock or forearms) and shoulder stocks (butts), which provide the user the ability to hold the firearm more steadily than a handgun. In addition, the long barrel of a long gun usually provides a longer sight plane for iron sights, providing the user with more precision when aiming. The presence of a stock makes the use of a telescopic sight or red dot sight more practical than with a hand gun. The mass of a long gun is usually greater than that of a short gun, making the long gun more expensive to transport, and more difficult and tiring to carry. The increased moment of inertia makes the long gun slower and more difficult to traverse and elevate, and it is thus slower and more difficult to adjust the aim. However, this also results in greater stability in aiming. The greater size makes it less convenient to use in confined quarters, like hunting stands or the like.

Typically, a user of a long gun uses one hand to grip the barrel by the forearms, and another hand to pull the trigger.

The hand that grips the barrel by the forearms can be used to maneuver the long gun into position and stabilize the gun for firing. A common problem associated with long guns is the stability of the grip hand and control with the grip hand. As such, it is clearly desirable to provide a means for stabilizing the grip hand and/or controlling the barrel of the long gun more effectively. This may be especially true when other needs are required, including, but not limited to, adjusting the scope or electronics of the firearm, reloading the firearm, maneuvering in confined quarters, like hunting stands or the like, reversing hands, etc.

Therefore, it is readily apparent that there is a recognizable unmet need for a means or device for stabilizing the grip hand and/or controlling the barrel of the long gun more effectively. The instant disclosure is designed to address at least some of the above mentioned problems by providing a strap for a firearm that may increase the stability and/or control of the firearm.

SUMMARY

Briefly described, in a preferred embodiment, the present apparatus, system, and method overcomes the above-mentioned disadvantages and meets the recognized need for such a device by providing a wrist strap for the barrel of a firearm that aids in stabilizing the grip hand and/or controlling the barrel of the long gun more effectively.

The present apparatus, system, and method include a wrist strap for the barrel of a firearm. According to its major aspects and broadly stated, the present disclosure describes a wrist strap for the barrel of a firearm that generally may include a strap having a first end and a second end. The strap may have a loop at the first end. The strap may be configured to be attached to the firearm at the second end. Wherein the loop may be configured for a user to insert their grip hand and utilize their wrist for stabilizing and/or controlling the barrel of the firearm. Whereby, the strap may provide increased stability and/or control of the barrel of the firearm.

One feature may be the inclusion of an attachment device with the wrist strap that may be configured for attaching the second end of the strap to the firearm. In select embodiments, the attachment device may be configured to connect directly to the barrel or forestock of the firearm. In other select embodiments, the attachment device may be configured to connect to a sling of the firearm. In these sling attachment embodiments, the attachment device may be configured to connect to a swivel connection of the sling, wherein the attachment device may include a strip and a pin. The strip may be at the second end of the strap and may be sized to fit through the swivel connection of the sling. The strip may include at least one slot. Whereby, when the strip is inserted through the swivel connection of the sling, the pin may be inserted through one of the at least one slots for locking the strip of the attachment device in the swivel connection.

Another feature may be that the attachments device may be adjustable. In select embodiments, the at least one slot in the strip may include a plurality of slots for providing adjustable distances from the firearm to the first end of the strap. The plurality of slots may be spaced apart an increment distance. For example, the increment distance may be 0.5 inches between each slot.

Another feature may be that the pin of the attachment device may be a linchpin. As an example, the linchpin may include a ring that can be folded over upon the strap for holding the linchpin in the slot.

Another feature may be that the loop is adjustable in size for various sized hands and wrists and/or for various desired lengths from the attachment device.

In select embodiments, the loop may be made from a flexible material. For example, the flexible material of the loop may be a strip of mesh.

One attribute of the instant wrist strap is that it may provide an increased force to the shoulder stock of the firearm. In select embodiments, the increased force to the shoulder stock of the firearm may be an increase of between 1 and 200%. In other select embodiments, the increased force to the shoulder stock of the firearm may be an increase of 100% or approximately 100%.

The instant disclosure also provides for a firearm system that includes any of the various embodiments of the wrist strap as shown and/or described herein. The firearm system may generally include a firearm with a barrel and the wrist strap attached to the barrel of the firearm. Wherein the loop of the wrist strap is configured for a user to insert a grip hand and utilize their wrist for stabilizing and/or controlling the barrel of the firearm. Whereby the strap may provide increased stability and/or control of the barrel of the firearm.

In select embodiments of the firearm system, the firearm is a long gun. As examples, the long gun can be a rifle, a shotgun, a musket, a blunderbuss, a carbine, a wall gun, a musketoon, the like, etc.

In use, a method of providing increased stability and/or control of the barrel of a firearm may be carried out utilizing any of the various embodiments of the wrist strap for the barrel of a firearm as shown and/or described herein. In general, the method of providing increased stability and/or control of the barrel of a firearm may include the step of connecting the wrist strap to a barrel of a firearm in any of the various embodiments, as shown and/or described herein. The method then includes the steps of: inserting the user's grip hand inside the loop of the strap; pulling back on the loop with the user's wrist; and gripping the barrel of the firearm. Whereby, the strap may provide increased stability and/or control of the barrel of the firearm.

These and other features of the removable oversized golf grip will become more apparent to one skilled in the art from the prior Summary, and following Brief Description of the Drawings, Detailed Description, and Claims when read in light of the accompanying Detailed Drawings.

BRIEF DESCRIPTION OF THE DRAWINGS

The present wrist strap for the barrel of a firearm will be better understood by reading the Detailed Description with reference to the accompanying drawings, which are not necessarily drawn to scale, and in which like reference numerals denote similar structure and refer to like elements throughout, and in which.

Figure 1:
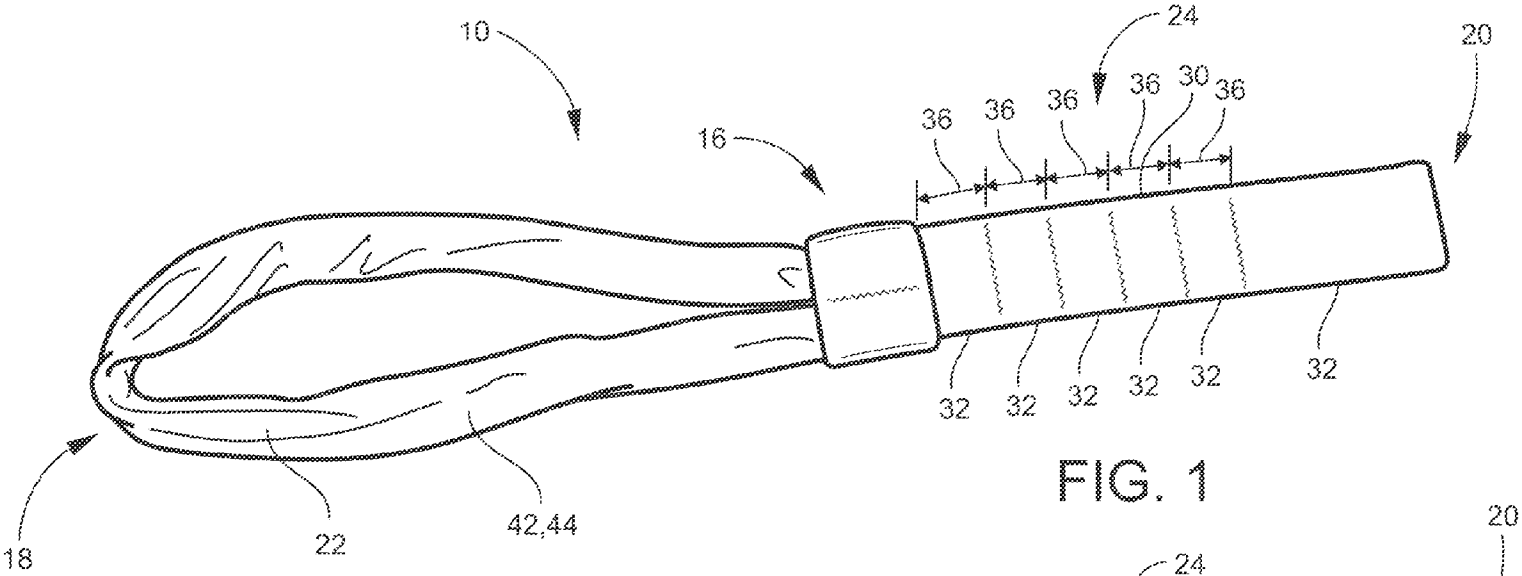
FIG. 1 is a top view of an exemplary embodiment of the wrist strap for the barrel of a firearm according to the instant disclosure.
Figure 2:
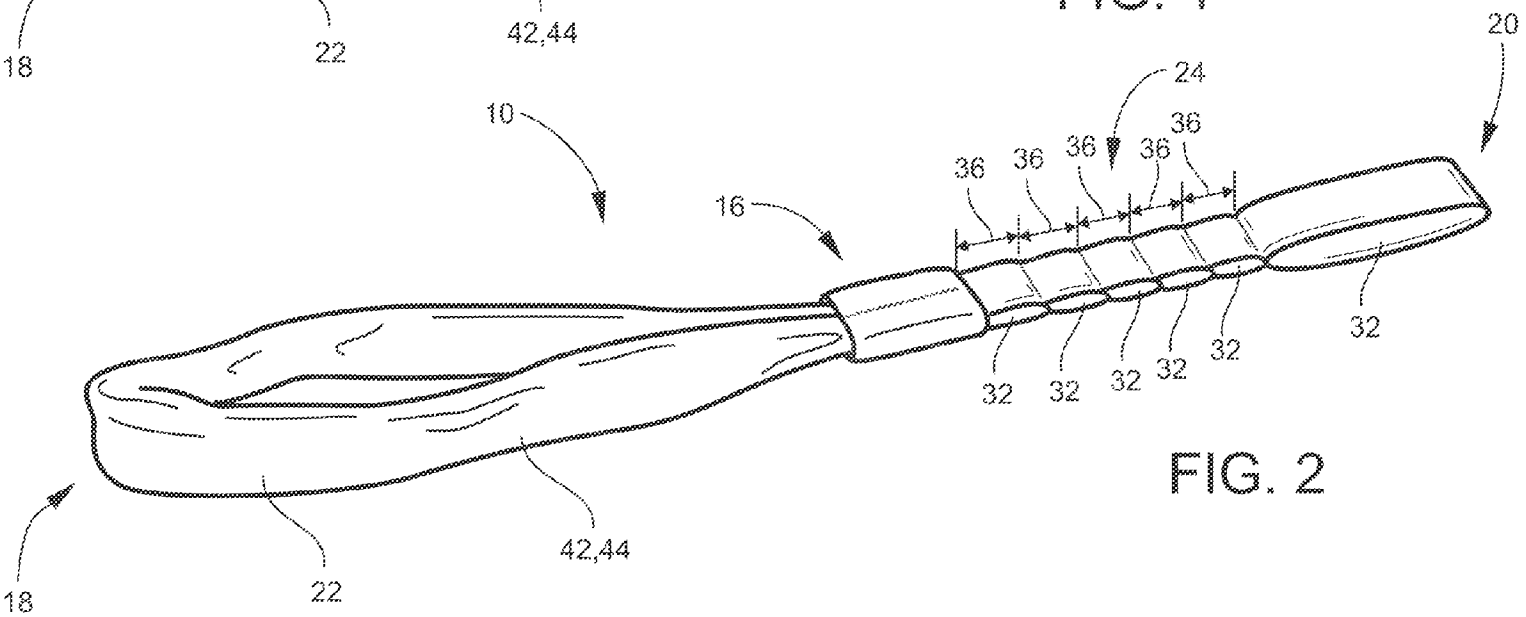
FIG. 2 is a perspective view of the wrist strap of FIG. 1.
Figure 3:
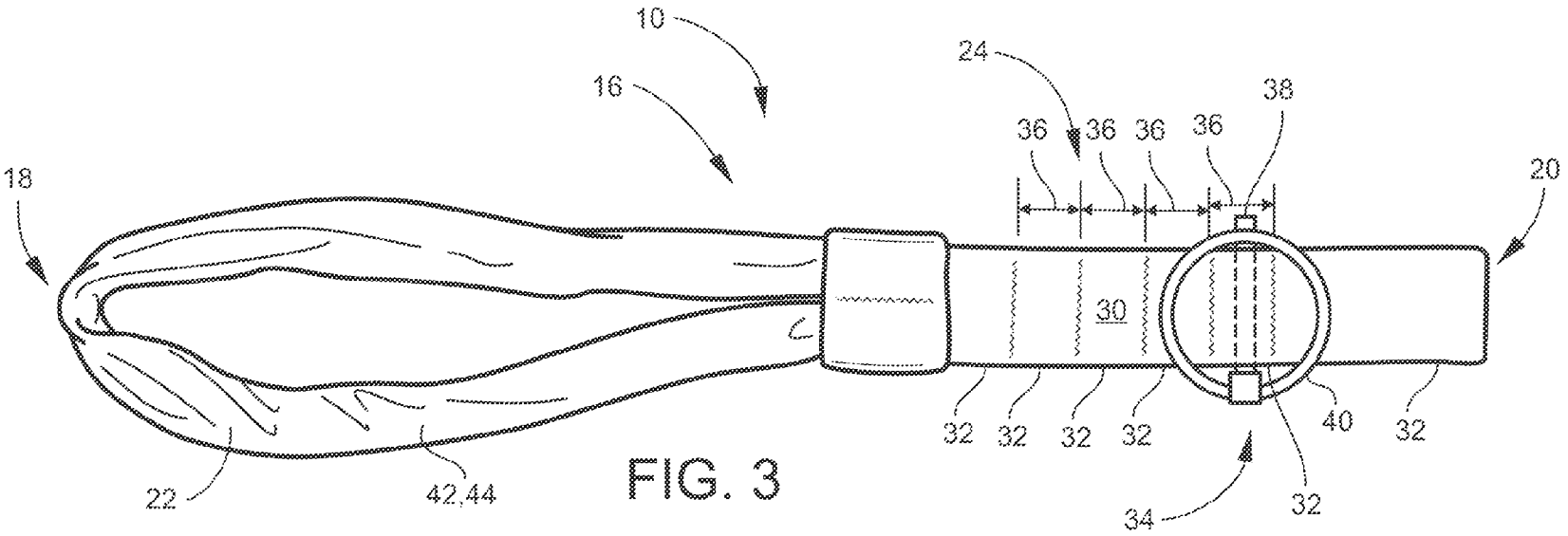
FIG. 3 is a top view of another exemplary embodiment of the wrist strap for the barrel of a firearm according to the instant disclosure with the pin inserted through one of the slots.
Figure 4:
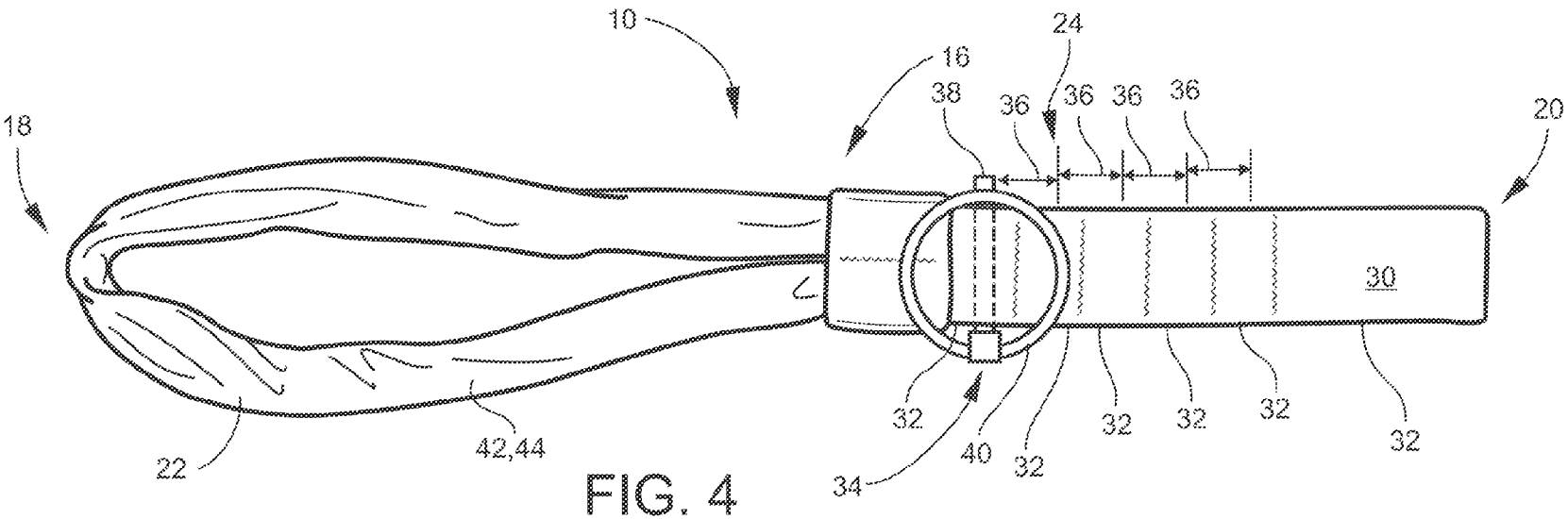
FIG. 4 is another top view of the wrist strap from FIG. 3 with the pin inserted through a different slot.
Figure 5:
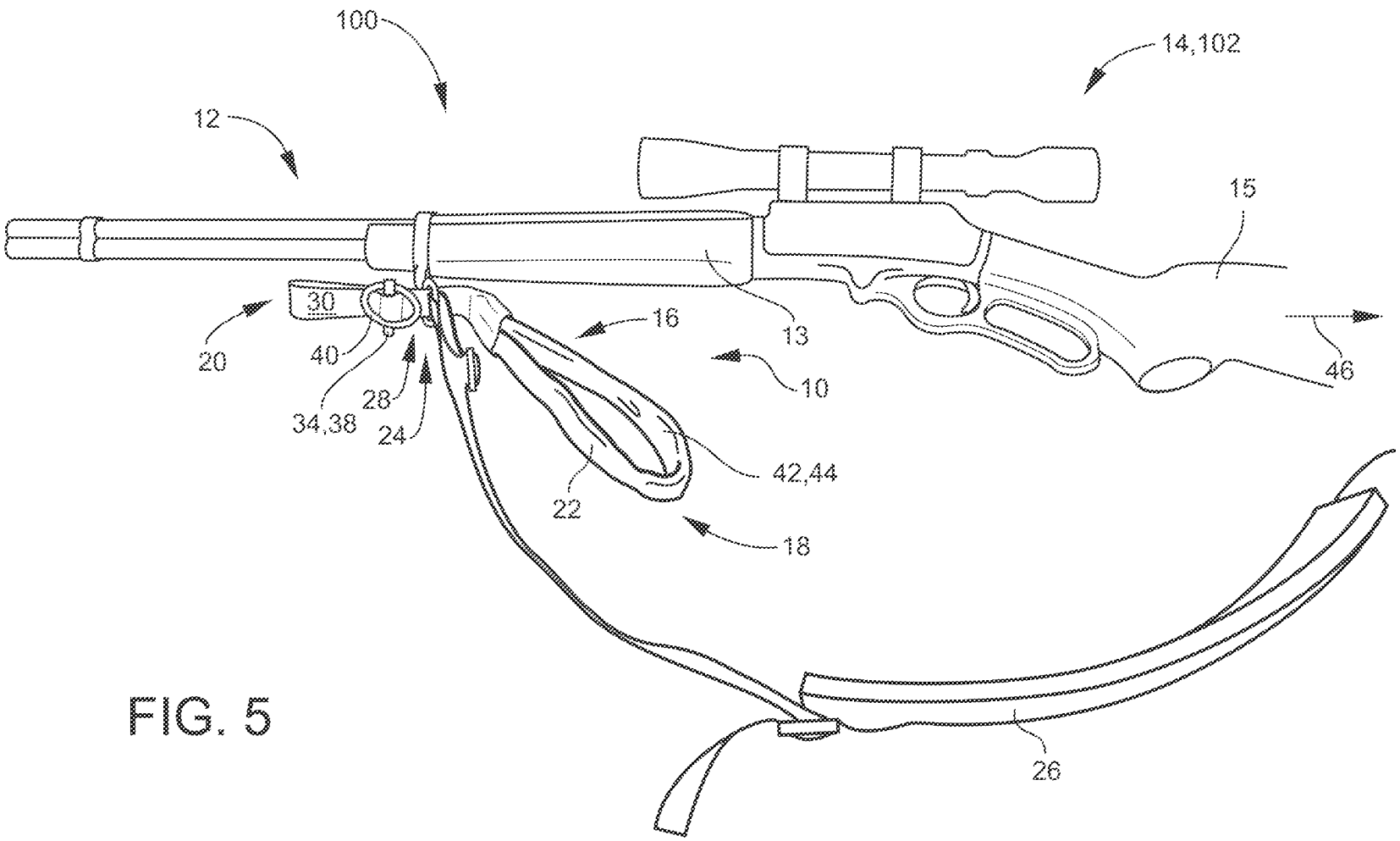
FIG. 5 is a perspective view of an exemplary embodiment of the firearm system according to the instant disclosure with the wrist strap installed on the firearm through the swivel connection of the swing.
Figure 6:
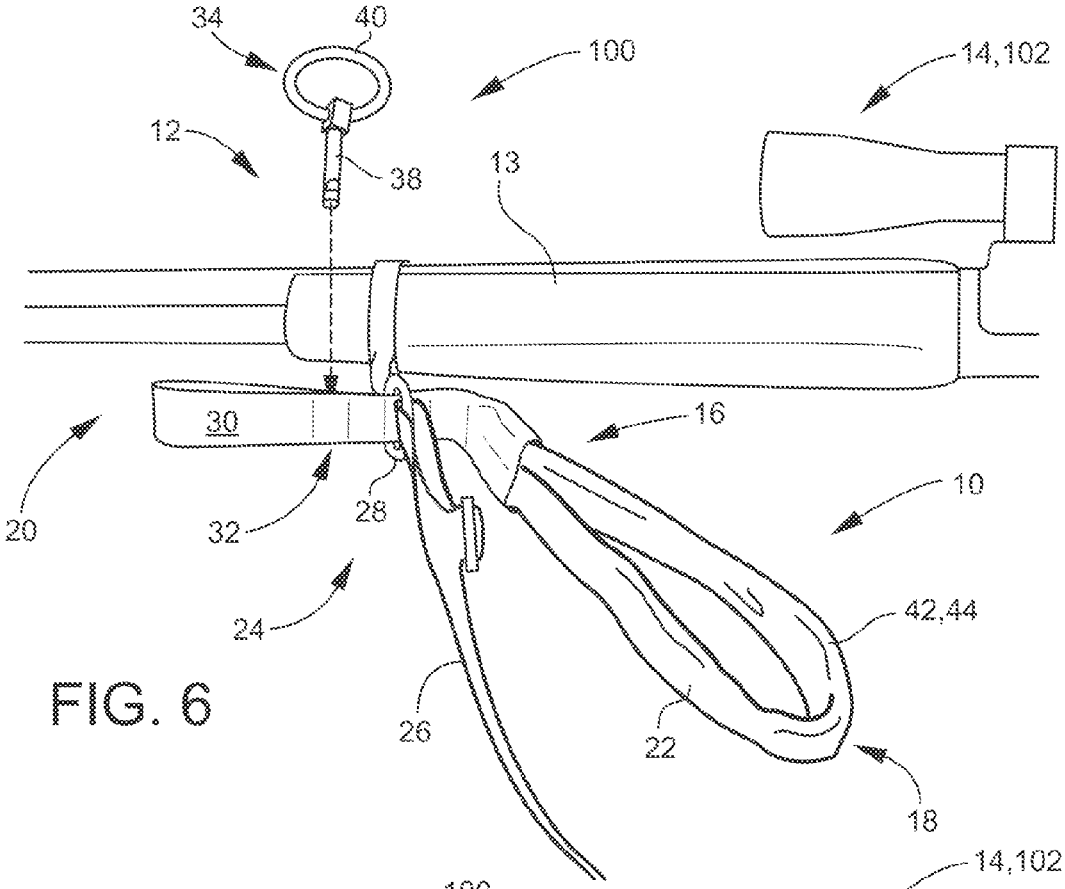
FIG. 6 is a close-up perspective view of the firearm system of FIG. 5 showing the strip inserted through the swivel connection and ready for the pin to be inserted.
Figure 7:
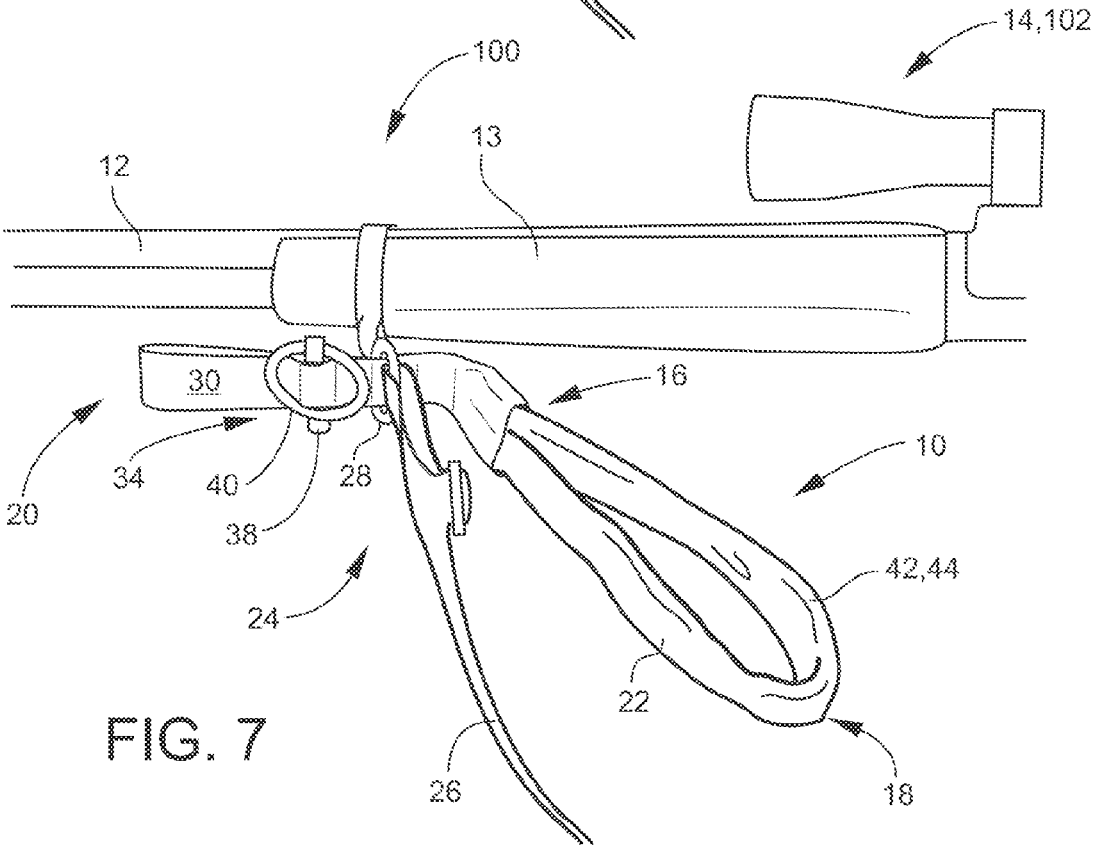
FIG. 7 is another close-up perspective view of the firearm system of FIG. 5 showing the strip inserted through the swivel connection and the pin inserted in one of the slots in the strip thereby locking the strip in the swivel connection.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

In describing the exemplary embodiments of the present disclosure, as illustrated in FIGS. 1-11, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Referring now to FIGS. 1-4 by way of example, and not limitation, therein is illustrated an example embodiment of wrist strap 10 for the barrel 12 of firearm 14. Wrist strap 10 may be designed, configured and used for aiding and/or providing increased stabilization and/or control of barrel 12 of firearm 14, including by providing increased force 46 to shoulder stock 15. Wrist strap 10 may generally include strap 16 with first end 18 and second end 20. Strap 16 may have any desired shape or size. Loop 22 may be located at first end 18, or approximate thereto. Strap 16 may be configured to be attached to firearm 14 at second end 20, or approximate thereto. Loop 22 may be configured (i.e. sized and shaped) for user U to insert their grip hand H and utilize their wrist W for stabilizing and/or controlling barrel 12 of firearm 14 (see FIGS. 8-10). As such, strap 16 may provide increased stability and/or control of barrel 12 of firearm 14.

Still referring to FIGS. 1-4, in select embodiments, wrist strap 10 may further include attachment device 24. Attachment device 24 may be configured for attaching second end 20 of strap 16 to firearm 14. Attachment device 24 may include any device, mechanisms, means, or combinations thereof for attaching strap 16 to firearm 14. In select embodiments, attachment device 24 may be integrally formed with firearm 14. In other embodiments, attachment device 24 may be removable attached and/or retrofitted to firearm 14. Attachment device 24 may be attached at any desired location on firearm 14, like for aiding in stabilizing and/or controlling barrel 12 of firearm 14. In select embodiments, attachment device 24 may be configured to connect directly to barrel 12 or forestock 13 of firearm 14. In other select embodiments, attachment device 24 may be configured to connect to sling 26 of firearm 14 (see FIGS. 5-10).

Referring to FIGS. 1-10, in the select embodiments where attachment device 24 may be configured to connect wrist strap 10 to sling 26 of firearm 14, attachment device 24 may be configured to connect to swivel connection 28. In these embodiments, attachment device 24 may include, but is not limited to, strip 30 at second end 20 of strap 16 and pin 34. Strip 30 may be configured, sized, shaped, designed, etc. to fit through swivel connection 28 of sling 26. Strip 30 may include at least one slot 32. Whereby, when strip 30 may be inserted through swivel connection 28 of sling 26, pin 34 may be inserted through one of the at least one slots 32 to lock strip 30 in swivel connection 28. Strip 30 may include any desired amount of slots 32, including a plurality of slots 32. The plurality of slots 32 may provide adjustable distances 36 from firearm 14 to first end 18 of strap 16. Strip 30 may include any desired number of slots 32 for providing any desired number of adjustments. For example, the plurality of slots 32 may include four or more slots 32 for providing four or more different adjustment lengths. The slots 32 may be spaced apart any desired distances, whether constant, random, or incremental. In select embodiments, the plurality of slots 32 may be spaced apart increment distance 36 of 0.5 inches between each slot 32. Strip 30 may be made from any material or combinations of materials. In addition, slots 32 may be created in strip 30 by any fastening means, like, sewing, gluing, welding, the like, and/or combinations thereof. For example, strip 30 may be created from a polyester flat webbing material (similar to a bookbag strap) that is folded over upon itself and sewn together in spaced locations to create slots 32. Strip 30 may have any desired width to fit inside various sized swivel connections 28 of sling 26. For example, strip 30 may have a width of approximately 1 inch for most standard swivel connections 28. In addition, strip 30 may have any desired width for provide any number and amount of adjustments from firearm 14. For example, strip 30 may have a length of approximately 6 inches.

Referring to FIGS. 3-10, pin 34 may be included in attachment device 24 for holding strip 30 in swivel connection 28. Pin 34 may be any pin type device, or similar thereto, that can be inserted through one of slots 32 for holding strip 30 in swivel connection 28. In select embodiments, pin 34 may be linchpin 38. Linchpin 38 may be any linchpin device, or similar thereto. Linchpin 38 may be configured to hold linchpin 38 in its desired slot 32. For example, as shown in the Figures, linchpin 38 may include ring 40 that can be folded over on top of strip 30 for aiding in holding linchpin 38 in the desired slot 32.

Loop 22 may be any desired size and/or shape. For example, loop 22 may have an approximate length of 9 inches when flattened out, or approximately 18 inches around the perimeter. In select embodiments, loop 22 may be adjustable in size for various sized grip hands H and wrists W of user U and/or for various lengths from firearm 14. Loop 22 may be adjustable by any means or fashion.

Loop 22 and strap 16 may be made from any desired material or combination of materials. In select embodiments, loop 22 and strap 16 may be made from flexible material 42. This flexibility of the material may allow strap 16 to conform around the user's wrist W comfortably and may allow the user U to enter and remove its hand H. In addition, the flexible material may be safer to transport and operate. Flexible material 42 may be any flexible material, like fabrics, plastics, rubbers, the like, combinations thereof, etc. In select embodiments, as shown in the Figures, flexible material 42 of loop 22 may be strip of mesh 44. The strip of mesh may be looped together and sewn at its ends to create loop 22. Loop 22 may be then sewn together to strip 30. Loop 22 may also provide an outer cushion or cloth material for added comfort and/or improved aesthetics.

One feature of wrist strap 10 may be that it can be utilized to provide increased force 46 to shoulder stock 15 of firearm 14. See FIGS. 5 and 10. Utilizing wrist strap 10 by inserting the user's grip hand and pulling against loop 22 with the user's wrist W while gripping the forestock of firearm 14 may provide increased force 46, i.e. the amount of force that one can pull back on firearm 14 against the user's shoulder is increased by using firearm 14 with wrist strap 10 versus using firearm 14 without wrist strap 10. In select embodiments, increased force 46 to shoulder stock 15 of firearm 14 may be an increase of between 1 and 200% versus the force on shoulder stock 15 of firearm 14 without using wrist strap 10. In other select embodiments, increased force 46 to shoulder stock 15 of firearm 14 may be an increase of 100% or approximately 100% versus the force on shoulder stock 15 of firearm 14 without using wrist strap 10.

Referring now to FIGS. 5-10 by way of example, and not limitation, therein is illustrated an example embodiment of firearm system 100 with wrist strap 10 for the barrel 12 of firearm 14. Wrist strap 10 used in firearm system 100 may be any of the various embodiments of wrist strap 10 as shown and/or described herein. Firearm 14 used with firearm system 100 and wrist strap 10 may be any firearm, gun, the like, etc. For example firearm 14 used with firearm system 100 and wrist strap 10 may be any firearm requiring or desiring increased stability and/or control over its barrel, including the barrel's forestock. As shown in FIGS. 5-10, in select embodiments, firearm 14 may be long gun 102. Long gun 102 used in firearm system 100 with wrist strap 10 may be any long gun or similar device including, but not limited to, any rifles, shotguns, muskets, blunderbusses, carbines, wall guns, musketoons, the like, etc. Firearm system 100 and wrist strap 10 may be used to provide increased stability and/or control of long gun 102.

Figure 8:
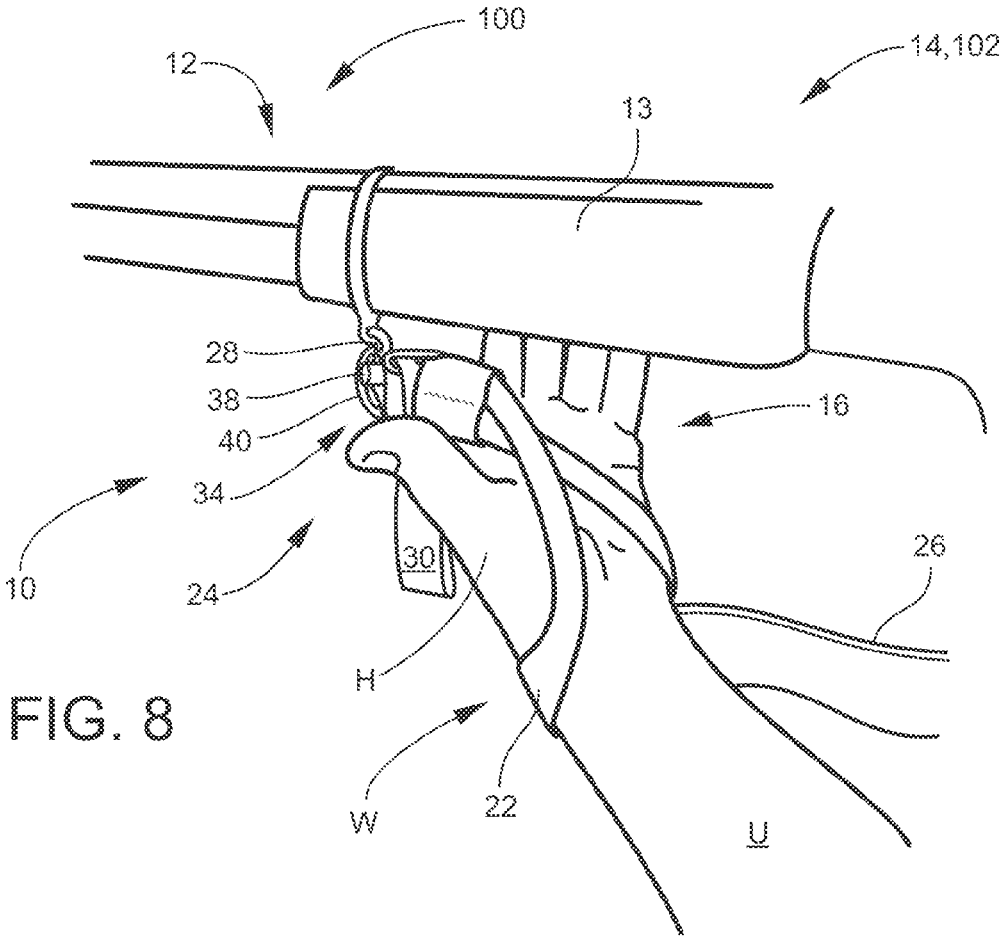
FIG. 8 is another close-up perspective view of the firearm system of FIG. 5 with the user inserting their grip hand through the loop and beginning to pull back on the strap.
Figure 9:
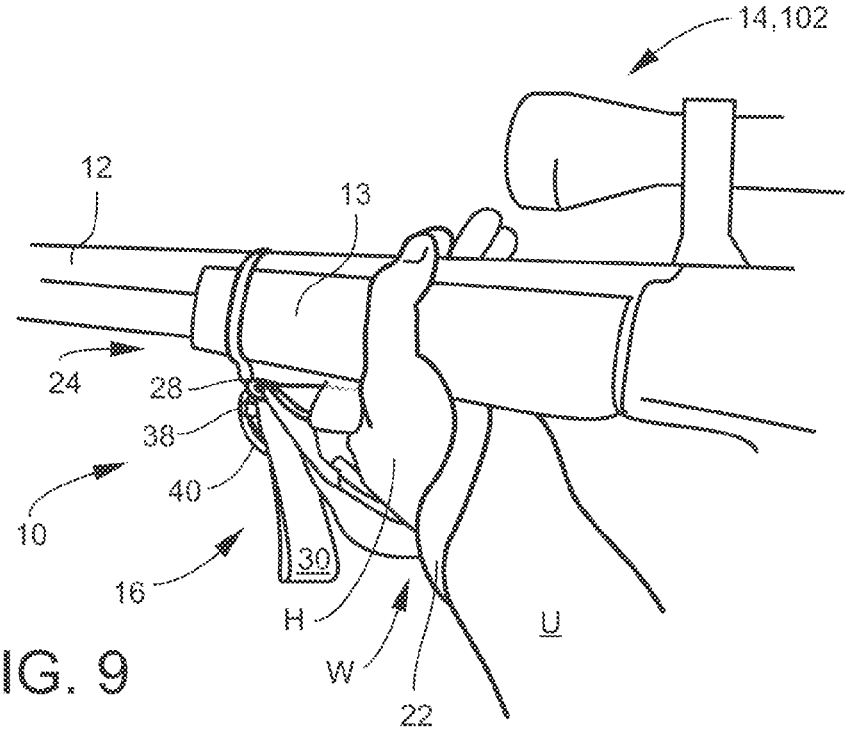
FIG. 9 is another close-up perspective view of the firearm system of FIG. 5 with the user pulling back on the strap and gripping the forestock for stabilizing and/or controlling the barrel of the firearm.
Figure 10:
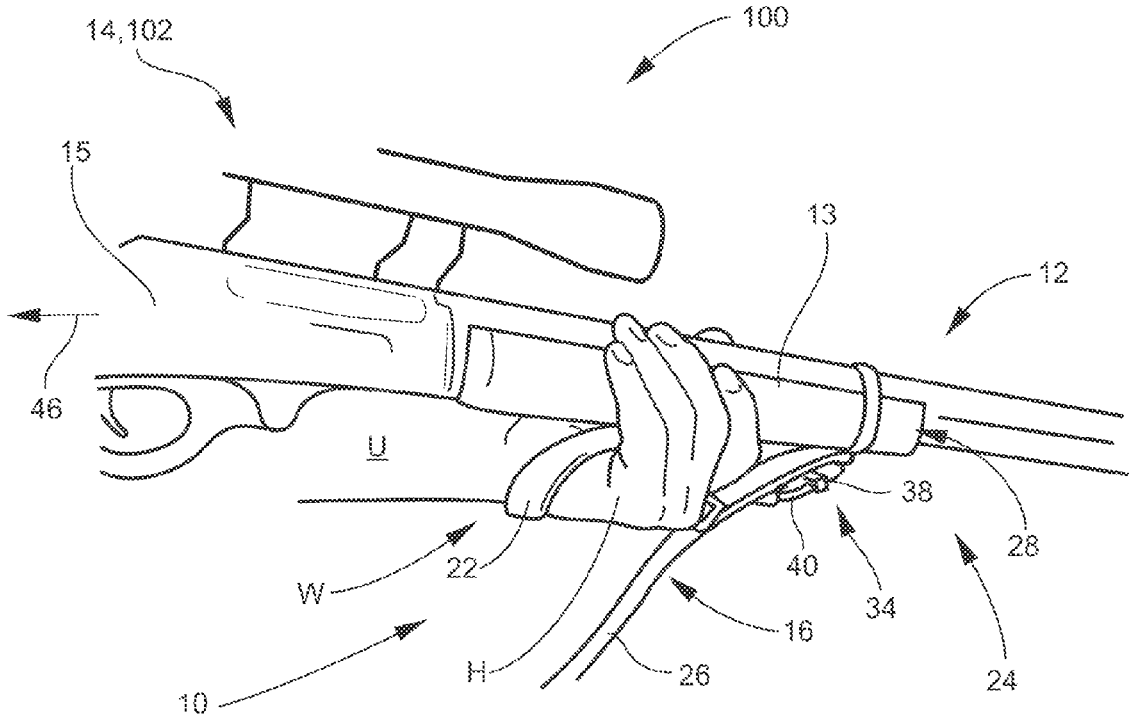
FIG. 10 is another close-up perspective view of the firearm system of FIG. 5 with the user pulling back on the strap and gripping the forestock for stabilizing and/or controlling the barrel of the firearm.

As shown in FIGS. 5-10, more specifically, the instant disclosure may include firearm system 100 with wrist strap 10 for barrel 12 of firearm 14, like barrel 12 of long gun 102. Wrist strap 10 may be utilized in firearm system 100 by user U to aid in stabilizing and/or controlling barrel 12 of firearm 14. As shown in FIGS. 8-10, user U may insert their hand H inside loop 22 (see FIG. 8) and pull back on loop 22 with their wrist W while gripping forestock 13 of barrel 12 (see FIGS. 9 and 10). This combined pulling back on loop 22 with the user's wrist W may provide increased force 46 on shoulder stock 15 (see FIGS. 5 and 10). As a result, the user U may have increased stabilization and/or control of barrel 12 of firearm 14. This increased stabilization and/or control of barrel 12 may aid the user in controlling, stabilizing, and/or operating firearm 14, including increased control and operation with just one hand, like grip hand H. This may be especially true when other needs are required, including, but not limited to, adjusting the scope or electronics of firearm 14, reloading firearm 14, maneuvering in confined quarters, like hunting stands or the like, reversing hands, etc.

In select embodiments of firearm system 100 with wrist strap 10, attachment device 24 may be included for attaching second end 20 of strap 16 to firearm 14. In select embodiments, firearm system 100 may include sling 26 with swivel connection 28 on firearm 14. In these select embodiments, attachment device 24 of firearm system 100 may be configured to connect to swivel connection 28 of sling 26. Also, in these embodiments of firearm system 100, wrist strap 10 may include strip 30 at second end 20 of strap 16 configured to fit through swivel connection 28 of sling 26, where strip 30 may include at least one slot 32 and pin 34. Whereby, when strip 30 may be inserted through swivel connection 28 of sling 26, pin 34 may be inserted through one of the at least one slots 32 for locking strip 30 in swivel connection 28.

Figure 11:
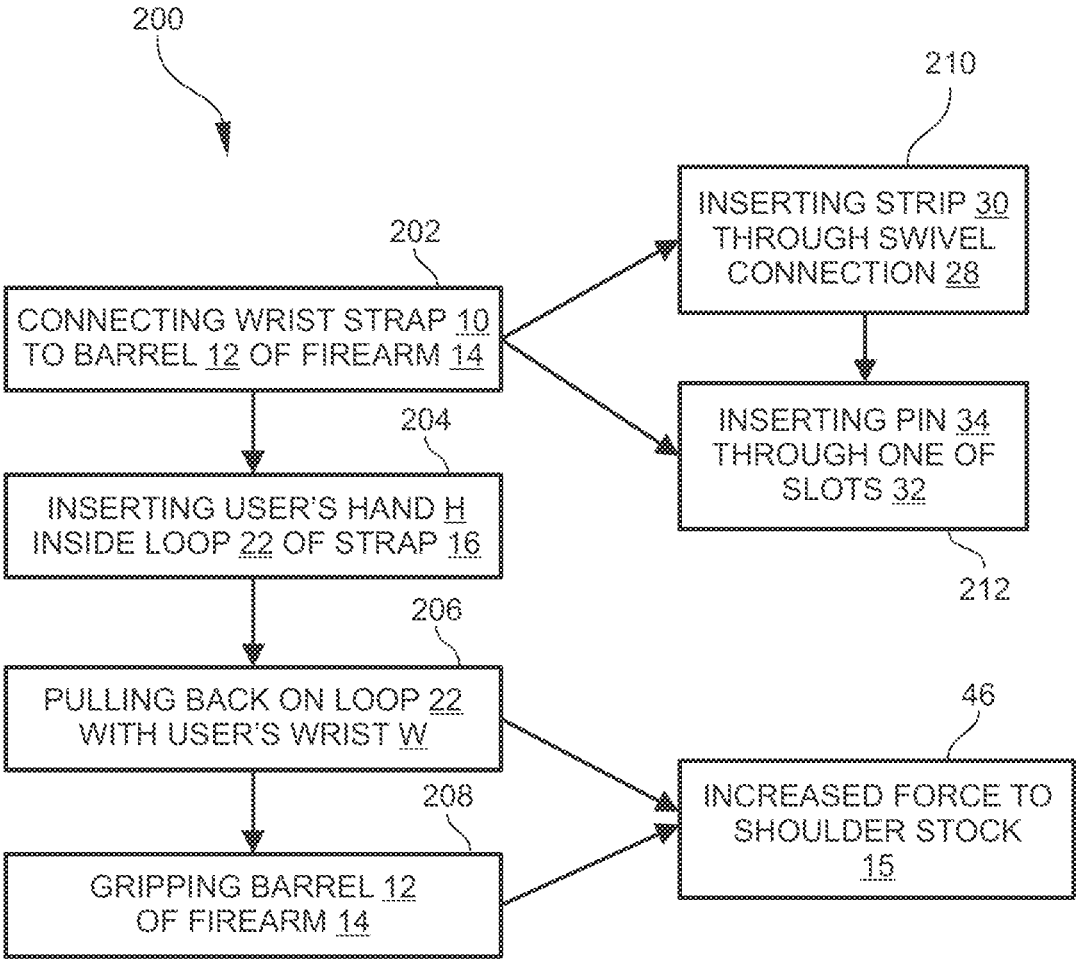
FIG. 11 is a flow diagram of an exemplary embodiment of the method of providing increased stability and/or control of the barrel of a firearm according to the instant disclosure.

Referring now to FIG. 11, in use, method 200 of providing increased stability and/or control of barrel 12 of firearm 14 may be carried out utilizing any of the various embodiments of wrist strap 10 as shown and/or described herein. In general, method 200 of providing increased stability and/or control of barrel 12 of firearm 14 may include the steps of: step 202 of connecting wrist strap 10 to barrel 12 of firearm 14 in any of the various embodiments of wrist strap 10 shown and/or described herein; step 204 of inserting the user's hand H inside loop 22 of strap 16 (see FIG. 8); step 206 of pulling back on loop 22 with the user's wrist W (see FIGS. 9 and 10); and step 208 of gripping barrel 12 (via forestock 13) of firearm 14 (see FIGS. 9 and 10). Whereby, the steps 206 and 208 of pulling loop 22 and gripping allows for strap 16 to aiding and/or provide increased stability and/or control of barrel 12 of firearm 14.

In select embodiments of method 200 of providing increased stability and/or control of barrel 12 of firearm 14, when firearm 14 has sling 26 with swivel connection 28 on forestock 13 of barrel 12, step 202 of connecting wrist strap 10 to barrel 12 of firearm 14 may further include the steps of: step 210 of inserting strip 30 on second end 20 of strap 16 with at least one slot 32 through swivel connection 28; and step 212 of inserting pin 34 through one of slots 32 in strip 30. Whereby, pin 34 may lock strip 30 in swivel connection 28.

The strap or wrist strap of the instant disclosure may be provided to increase the stability and/or control of the firearm. The increased control and/or stability of the firearm may be provided by allowing a user to increase force to the butt of the firearm. This increased force may vary depending on the user, but may increase between 1% and 200%, or approximately 100%. This increased control and/or stability from the added force to the butt of the firearm may be especially advantageous when other needs are required, including, but not limited to, adjusting the scope or electronics of the firearm, reloading the firearm, maneuvering in confined quarters, like hunting stands or the like, reversing hands, etc.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

What is claimed is:

1. A wrist strap for a barrel of a firearm comprising:

a strap having a first end and a second end made from a flexible material;

said strap having a loop at the first end;

said strap is configured to be attached to the firearm at the second end;

an attachment device, said attachment device is configured for attaching the second end of said strap to the firearm;

said attachment device is configured to connect to a swivel connection of a sling of said firearm, wherein said attachment device comprises:

a strip at the second end of said strap configured to fit through said swivel connection of said sling, said strip including a plurality of slots across the width of the strip for adjusting a length of the strip; and a pin;

whereby, when said strip is inserted through the swivel connection of said sling and said pin is inserted across the width of the strip through one of said slots, said pin locks said strip in said swivel connection for securing the strip at a desired length.

2. The wrist strap according to claim 1, wherein said loop is configured for a user to insert their hand and utilize their wrist for stabilizing and/or controlling the barrel of the firearm;

whereby said strap providing increased stability and/or control of the barrel of the firearm.

3. The wrist strap according to claim 1, wherein said plurality of slots are spaced apart an increment distance, wherein said increment distance is 0.5 inches between each slot.

4. The wrist strap according to claim 1, wherein said pin is a linchpin, where said linchpin is configured to hold the linchpin in one of the plurality of slots.

5. The wrist strap according to claim 1, wherein said loop is adjustable in size for various sized hands and wrists and/or for various lengths from the firearm.

6. The wrist strap according to claim 1, wherein said loop is made from a strip of mesh.

7. The wrist strap according to claim 1, wherein said wrist strap is configured to provide an increased force to a shoulder stock of the firearm.

8. The wrist strap according to claim 7, wherein said increased force to the shoulder stock of the firearm is an increase of between 1 and 200%.

9. A firearm system with a wrist strap for providing increased stability and/or control comprising:

a firearm with a barrel;

a sling with a swivel connection on the barrel of the firearm;

a wrist strap for the barrel of the firearm comprising:

a strap having a first end and a second end made from a flexible material;

said strap having a loop at the first end;

said strap being attached to the firearm at the second end; and an attachment device, said attachment device is configured for attaching the second end of said strap to the swivel connection of the sling on the firearm, said attachment device comprises:

a strip at the second end of said strap configured to fit through said swivel connection of said sling, said strip including a plurality of slots across the width of the strip for adjusting a length of the strip; and a pin;

whereby, when said strip is inserted through the swivel connection of said sling and said pin is inserted across the width of the strip through one of said slots, said pin locking said strip in said swivel connection for securing the strip at a desired length;

wherein said loop is configured for a user to insert a hand and utilize their wrist for stabilizing and/or controlling the barrel of the firearm;

whereby said strap providing increased stability and/or control of the barrel of the firearm.

10. The firearm system of claim 9, wherein the firearm is a long gun selected from a group consisting of: a rifle; a shotgun; a musket; a blunderbuss; a carbine; a wall gun; and a musketoon.

11. A method of providing increased stability and/or control of a barrel of a firearm comprising the steps of:

connecting a wrist strap to the swivel connection of a sling on the barrel of the firearm, said wrist strap comprising:

a strap having a first end and a second end made from a flexible material;

said strap having a loop at the first end;

said strap being attached to the firearm at the second end; and an attachment device, said attachment device is configured for attaching the second end of said strap to the swivel connection of the sling on the firearm, said attachment device comprises:

a strip at the second end of said strap configured to fit through said swivel connection of said sling, said strip including a plurality of slots across the width of the strip for adjusting a length of the strip; and a pin;

whereby, when said strip is inserted through the swivel connection of said sling and said pin is inserted across the width of the strip through one of said slots, said pin locking said strip in said swivel connection for securing the strip at a desired length;

inserting a user's hand inside the loop of the strap; and pulling back on the loop with a user's wrist; and gripping the barrel of the firearm;

whereby said strap providing increased stability and/or control of the barrel of the firearm.

* * * * *